US008835790B2

(12) United States Patent
Kantas

(10) Patent No.: US 8,835,790 B2
(45) Date of Patent: Sep. 16, 2014

(54) WINDING FOR A CONTACT OF A MEDIUM-VOLTAGE VACUUM CIRCUIT-BREAKER WITH IMPROVED ARC EXTINCTION, AND AN ASSOCIATED CIRCUIT-BREAKER AND VACUUM CIRCUIT-BREAKER, SUCH AS AN AC GENERATOR DISCONNECTOR CIRCUIT-BREAKER

(75) Inventor: Said Kantas, Montpellier (FR)

(73) Assignee: Schneider Electric Energy France, Rueil Malmaison (FR)

( * ) Notice: Subject to any disclaimer, the term of this patent is extended or adjusted under 35 U.S.C. 154(b) by 207 days.

(21) Appl. No.: 13/497,367

(22) PCT Filed: Sep. 27, 2010

(86) PCT No.: PCT/EP2010/064233
§ 371 (c)(1),
(2), (4) Date: Mar. 21, 2012

(87) PCT Pub. No.: WO2011/039133
PCT Pub. Date: Apr. 7, 2011

(65) Prior Publication Data

US 2012/0181254 A1 Jul. 19, 2012

(30) Foreign Application Priority Data

Sep. 29, 2009 (FR) ..... 09 56744

(51) Int. Cl.
*H01H 33/66* (2006.01)

(52) U.S. Cl.
USPC ..... 218/129

(58) Field of Classification Search
CPC ..... H01H 37/56; H01H 71/161
USPC ..... 218/123–129
See application file for complete search history.

(56) References Cited

U.S. PATENT DOCUMENTS 3,469,050 A 9/1969 Robinson et al.
3,683,139 A * 8/1972 Ludwig ..... 218/123
(Continued)

FOREIGN PATENT DOCUMENTS

CN 85108391 A 8/1986
CN 1384514 A 12/2002
(Continued)

OTHER PUBLICATIONS

International Search Report issued Jan. 11, 2011 in PCT/EP2010/064233.

(Continued)

*Primary Examiner* — Truc Nguyen
(74) *Attorney, Agent, or Firm* — Oblon, Spivak, McClelland, Maier & Neustadt, L.L.P.

(57) ABSTRACT

A design for a winding is based on a material of low electrical resistance, such as copper, and of a diameter typically greater than 90 mm, intended to generate a magnetic field in an electrical contact for a medium voltage vacuum circuit-breaker. The winding includes a hollow cylinder including helical slots that are empty of material, arranged in parallel around its longitudinal axis, and that open out both to the hollow and to the outside of the cylinder. The angular length of each helical slot is equal to at least 360°. The design makes it possible to increase the level of the axial magnetic field (AMF) obtained by the winding(s) incorporated into an electrical contact of a vacuum circuit-breaker while improving uniformity, symmetry of the field, and production cost.

20 Claims, 5 Drawing Sheets

(56) References Cited

U.S. PATENT DOCUMENTS

| | | | | |
|---|---|---|---|---|
| 3,740,507 | A * | 6/1973 | Kuhl et al. | 218/129 |
| 3,764,764 | A * | 10/1973 | Takasuna et al. | 218/127 |
| 4,390,762 | A | 6/1983 | Watzke | |
| 5,691,521 | A | 11/1997 | Komuro et al. | |
| 5,691,522 | A | 11/1997 | Schulman et al. | |
| 6,747,233 | B1 | 6/2004 | Glinkowski | |
| 8,164,019 | B2 | 4/2012 | Schlaug et al. | |
| 8,168,910 | B2 | 5/2012 | Schlaug et al. | |
| 8,288,674 | B2 | 10/2012 | Kantas et al. | |
| 8,450,630 | B2 * | 5/2013 | Stoving | 218/123 |
| 2008/0302764 | A1 * | 12/2008 | Stoving | 218/129 |
| 2011/0000887 | A1 | 1/2011 | Schlaug et al. | |
| 2011/0006041 | A1 | 1/2011 | Schlaug et al. | |
| 2011/0073566 | A1 | 3/2011 | Kantas et al. | |

FOREIGN PATENT DOCUMENTS

| | | | |
|---|---|---|---|
| CN | 1405813 | A | 3/2003 |
| CN | 1144391 | A | 3/2005 |
| CN | 101086924 | A | 12/2007 |
| CN | 201118136 | Y | 9/2008 |
| DE | 35 07 317 | A1 | 9/1986 |
| DE | 195 13 790 | A1 | 10/1995 |
| DE | 195 03 661 | A1 | 7/1996 |
| EP | 0 747 917 | A2 | 12/1996 |
| EP | 0 747 917 | A3 | 12/1996 |
| EP | 1 367 619 | A2 | 12/2003 |
| EP | 1 367 619 | A3 | 12/2003 |
| FR | 2 946 790 | A1 | 12/2010 |
| FR | 2 946 791 | A1 | 12/2010 |
| FR | 2 946 792 | A1 | 12/2010 |

OTHER PUBLICATIONS

Preliminary Search Report issued Apr. 23, 2010 in French Patent Application No. 0956744 filed Sep. 29, 2009 (with English Translation of Categories of Cited Documents).

Homma, M., et al., "Physical and Theoretical Aspects of a New Vacuum Arc Control Technology", IEEE 18$^{th}$ Int. Symp. On Discharges and Electrical Insulation in Vacuum, 1998, pp. 415-422.

Office Action (with English translation) issued on Mar. 14, 2014, in counterpart Chinese Appln No. 201080053873.9 (29 pages).

* cited by examiner

WINDING FOR A CONTACT OF A MEDIUM-VOLTAGE VACUUM CIRCUIT-BREAKER WITH IMPROVED ARC EXTINCTION, AND AN ASSOCIATED CIRCUIT-BREAKER AND VACUUM CIRCUIT-BREAKER, SUCH AS AN AC GENERATOR DISCONNECTOR CIRCUIT-BREAKER

TECHNICAL FIELD

The invention relates to medium-voltage vacuum circuit-breakers, sometimes called vacuum bottles.

It relates more particularly to improving arc extinction in such vacuum circuit-breakers.

The main application is that in which vacuum circuit-breakers are used as break switches in alternating current (AC) generator disconnector circuit-breakers at the outlet from a power station.

PRIOR ART

Vacuum circuit-breakers have been used for very many years in medium-voltage electrical distribution switchgear to break short-circuit currents of the order of a few kiloamps (kA), typically 25 kA, at a few kilovolts (kV), typically 36 kV. In this type of distribution switchgear, vacuum circuit-breakers need also to withstand continuous current, typically of the order of 1250 amps (A) without overheating. The way they are implanted in the distribution network is such that those vacuum circuit-breakers are closed in normal operation of the network and they carry the continuous nominal current.

It is known in the art that in order to break such short-circuit currents, it is necessary to design the arcing contacts so that an intense axial magnetic field (AMF) or an intense radial magnetic field (RMF) is generated at their facing ends in order to extinguish the arc upon separation of the contacts.

In other words, breaking high currents in vacuum circuit-breakers requires the arcing contacts to have such arc control means incorporated therein: the arcing contacts therefore form an integral part of the vacuum circuit-breaker.

The function that these arc control means are expected to perform is to ensure the energy density of the arc created through the arcing contacts while the current is being broken remains below the limits required both for breaking the current and also for withstanding the recovery voltage in the vacuum space immediately after the current has been interrupted.

The above-mentioned AMF is generated parallel to the axis of the vacuum circuit-breaker whereas the likewise above-mentioned RMF creates a magnetic force that causes the arc to rotate at the periphery of the mechanical surface of the contact.

Such an AMF or RMF is created by the current itself as it flows through the arc control contacts.

Typically, the arc control means generating the AMF or RMF comprise two windings, one of which is mounted in the movable arcing contact and the other in the stationary arcing contact of a vacuum circuit-breaker. If the current flows in the same direction in both windings, the resulting magnetic fluxes add together in an axial direction of the vacuum circuit-breaker in the vacuum space between the two arcing contacts while opening or when separated from each other. If the current flows in a given winding in the opposite direction to the flow in the other winding, that results in a magnetic flux that extends radially in the vacuum space between the two separate arcing contacts.

The arc control means generating AMF theoretically have the first technical effect of preventing the arc from contracting in a precise zone. In other words, they need to enlarge the arc over a contact area that is as large as possible. The looked-for result is thus to spread the energy of the arc over an area that is as large as possible and that will thus enable the AC to be broken at the natural zero-crossing.

Effective AMF arc control means must therefore generate a high and uniform magnetic flux over the entire surface of the contact.

Typically, the breaking of currents in the range 30 kA to 50 kA requires the use of contacts of diameter lying in the range 50 millimeters (mm) to 80 mm. For such diameters, the AMF arc control means that are presently implemented give overall satisfaction.

However, certain vacuum circuit-breakers are used in applications where they may be subjected to short circuit currents for breaking of a few kiloamps, typically 63 kA, 80 kA to 160 kA. That necessarily requires the use of contacts of greater diameter, typically lying in the range 90 mm to 150 mm.

With such diameters, the inventors have found that an AMF is created with non-uniform distribution over the physical contact surface with a weaker field in the central portion, which causes the breaking performance of the vacuum circuit-breaker to be reduced.

Solutions have already been proposed for improving the magnetic flux generated by the contacts of a vacuum circuit-breaker, while also enabling them to withstand continuous currents in the closed position.

Some existing solutions entail either implanting additional ferromagnetic materials in the winding portion of the contact and/or in the electrode portion, or else producing slots in the contact body in order to reduce eddy currents locally, or else to combine both solutions.

Where implanting ferromagnetic materials is concerned, the U.S. Pat. No. 6,747,233 B1 discloses the use of magnetic rings with different saturations and permittivities $\mu$ in order to have magnetic fields of different profiles and different values as a function of the magnitudes of the currents, i.e. different for low currents and for high currents. To be more precise, both a saturable magnetic material 101, 401 and a non-saturable magnetic material 102, 402 are implanted in a contact body 104, 404 that is solid and essentially conductive and that is itself fastened to a mechanical connection rod portion 103 that is essentially conductive. In the embodiment envisaged, the relative values of the electrical resistivity of the saturable materials are the opposite of those of the non-saturable materials. Accordingly, in the embodiment shown in FIGS. 1A to 3, the saturable material 101 has high electrical resistivity and is implanted around a non-saturable material 102 that has low electrical resistivity. The major drawback of using ferromagnetic materials in contacts is that the contacts are magnetized and therefore subjected as it were to the force produced by the magnetic field. This force is reversed every 10 milliseconds (ms) for sinusoidal AC at a frequency of 50 hertz (Hz). The continuous presence of this force on the materials that are supposed to control the short-circuit arc tends to weaken the structure of the contact itself. Furthermore, the value of the magnetic field obtained with inserted ferromagnetic materials is not necessarily higher than that obtained without them.

The patents DE 195 03 661 and U.S. Pat. No. 4,390,762 each disclose a combined solution of producing slots and of implanting additional ferromagnetic materials.

To be more precise, patent DE 195 03 661 discloses a contact 1 comprising a hollow cylindrical tube 2 as the mechanical connecting rod portion, to which there is fastened the contact portion proper 3, which is magnetic. That magnetic contact portion 3 is hollow in its center and has a solid cylindrical winding portion 4 and an electrode disk portion 8 separated by a magnetic spacer 9 and a stainless steel or ceramic plate 10. Three identical spiral slots 5 are formed in the hollow contact 3 at 120° to one another, extending from its inside diameter 7, which coincides with the outside diameter of the tube 2, to its outside diameter 6. That kind of geometry produces a magnetic field that extends axially while also being radially distributed, and therefore creates a rotating arc that reaches a larger area of the contacts. In other words, that document discloses generating a radial magnetic field that causes the arc to turn in an annular zone at the periphery of the contacts.

U.S. Pat. No. 4,390,762, discloses a contact with a tubular mechanical connecting rod portion 1 to which there is fastened a cylindrical base 2 with a hollow center and that constitutes the winding portion of the contact, to which there is fastened a low annular contact ring 4. The mechanical connecting rod 1 and the cylindrical base are essentially made of copper, whereas the annular contact ring 4 is based on a chromium matrix saturated with copper. As can be seen in FIG. 2, the winding portion 2 comprises two concentric portions 3 separated by a high-grade steel 6 that fills a vertical annular hollow 5. Rectilinear radial slots are produced over a portion of the height of each of these portions 3. The slots are uniformly distributed over the periphery and oriented at the same angle of inclination to the axis of the cylinder 2, without intersecting it. The structure disclosed in that document increases the mechanical strength of the contacts.

Another existing solution is that described in the TOSHIBA publication, Proceedings ISDEIV 1998, pages 417-418, entitled "*Physical and theoretical aspects of a new vacuum arc control technology*". That solution consists in adding a second winding that is smaller than the first winding. The drawback of that solution is that the magnetic fields generated by the windings described are mutually opposed, which tends to reduce considerably the effective total magnetic field.

In order to resolve that problem, in the patent application FR 09 53852, filed on Jun. 10, 2009, and entitled "Contact pour ampoule à vide à moyenne tension à coupure d'arc améliorée, ampoule à vide et disjoncteur, tel qu'un disjoncteur sectionneur d'alternateur associés" [A contact for a medium-voltage vacuum circuit-breaker with improved arc extinction, and an associated vacuum circuit-breaker and circuit-breaker, such as an AC generator disconnector circuit-breaker] the Applicant has proposed a second winding electrically in parallel with the first winding and adapted to generate a magnetic field that is superposed on the magnetic field generated by the first winding.

That solution is generally satisfactory in the sense that it does indeed make it possible to increase the AMF and avoid it weakening at its center, by giving it a given profile that is effective over the entire surface of the end contact.

Patent DE 195 13790 describes a winding 33 for generating an AMF in a vacuum circuit breaker contact, and in its embodiment of FIG. 5, it has helical slots 50 of limited length that do not enable a magnetic field to be obtained that is uniform both at the surfaces of the arc control contacts and in the space between the contacts of the circuit breaker.

An object of the invention is to propose an improved solution that makes it possible to further increase the AMF in an electrical contact for a medium-voltage vacuum circuit-breaker, while avoiding weakening of the field at the center of the contact.

Another object of the invention is to improve the uniformity of the magnetic field over the surfaces of the contacts and in the space between the contacts of a vacuum circuit breaker, while reducing the cost of manufacture.

SUMMARY OF THE INVENTION

To do this, the invention provides a winding based on a material of low electrical resistance, such as copper, and of diameter typically greater than 90 mm, intended to create a magnetic field in an electrical contact for a medium voltage vacuum circuit-breaker, the winding consisting of a hollow cylinder including helical slots about its longitudinal axis that are parallel to one another and that open out both to the hollow and to the outside of the cylinder.

According to the invention, the angular length of each helix is equal to at least 360°. It is stated here that the notion of "angular length" of the helixes is to be understood in the usual mathematical sense: thus, in considering the projection of a helix on a plane perpendicular to its axis, the angular length of a helix is the value of the angle traveled by moving along its length between its two ends.

By methodically making helical slots that are parallel to one another with an angular length equal to at least 360°, the drawbacks of prior art windings are overcome.

The inventors have found that prior art windings with helical slots of shorter length generate non uniformity in the magnetic flux when the arc is created in a concentrated zone, in particular in a zone at the periphery of the contact having the winding. In prior art windings, at least for a certain time period, the current flows only in a limited portion of the strands that are defined individually by two slots. This is due to the fact that the arc may start from any point on the surface (the last point of contact for the two electrodes before they separate). It is very rare, or even impossible, to have more than one point of separation between the two surfaces of the two contacts. The other portions of the strands contribute little or not at all to generating the total magnetic flux. This is what concentrates the AMF even though it ought to be distributed over the entire surface of the arc so as to diffuse the arc. In addition, and even if the arc manages to be fed very quickly by all of the arc control strands, there remain zones of weak field, or in other words "wells", created by the discontinuities of the strands between one another. These weak magnetic field zones increase the risk of constriction. These zones of non-uniformity in the magnetic field of a winding imply there will be zones of non-uniformity in the magnetic field in the space between the two contacts, thereby giving rise to zones in which the plasma is disturbed while interrupting current. The harmful consequence is obtaining thermal loading that is not uniform over the surfaces of the contacts. For high short-circuit current values, this can affect the circuit-breaking performance of a vacuum circuit breaker. The larger the diameter of the arc control, the larger these weak field zones. The smaller the number of strands, the larger the zones (with geometry similar to that of the prior art in FIG. 3).

The AMF field generated by the winding of the invention implanted in a medium voltage contact is uniform, i.e. symmetrical and constant, both at the surface of the contact and in the space between the contacts, and of a value that is much higher than the flux generated by prior art windings.

For an angular length value of at least 360°, a winding of the invention may generate an AMF that is increased by a factor of 2 to 3 relative to the flux generated by a prior art winding.

Further, a winding of the invention makes it possible to increase the mechanical endurance of a contact that is of large size, typically lying in the range 90 mm and 150 mm, and in which the winding is incorporated.

In addition, the stability of the AMF arc control when the current is broken is improved with a winding of the invention. The inventors have found that for winding lengths of less than 360°, the AMF is not necessarily uniform when the arc is created locally. In this event, the current flows in preferred manner in one or two strands of the winding, at least for a certain time period. Thus, the other strands contribute little or not at all to obtaining the total magnetic field. This results in the AMF being localized whereas in order to be effective it should be distributed over the largest possible area of the contact. Thus, a winding of the invention with helical slots of angular lengths that are equal to at least 360° generate an AMF that is high and uniform whatever the position of the initial arc.

Preferably, the width of each slot is less than 0.5 mm for an outside diameter ϕ ext of the hollow cylinder that is greater than 90 mm.

Preferably still, each strand individually defined by two consecutive helical slots presents a section parallel to the longitudinal axis of the winding that is substantially rectangular and identical over the entire height of the winding.

In an advantageous characteristic, the number of parallel helical slots is equal to at least two, and advantageously equal to six.

The invention also provides a method of making a winding based on a material of low electrical resistance, such as copper, intended to generate a magnetic field in an electrical contact for a medium voltage vacuum circuit-breaker, the method including the step of making a hollow cylinder with helical slots arranged around its longitudinal axis, and opening out both to the hollow and to the outside of the cylinder, the cylinder being empty of material, in which step the angular length of each helical slot is equal to at least 360°.

Advantageously, the helical slots of angular length greater than or equal to 360° are made by electric discharge machining. The method of making a winding of the invention is of reduced cost because the number of operations required for making the slots is also reduced.

Compared to the shape of FIG. 3, the new shape of a winding of the invention presents a number of just six strands instead of twelve. In addition, making twelve strands in a prior art winding shown in FIG. 3, requires an equal number (twelve) of cutting passes. However, the making of six strands in the new shape of the winding of the invention requires just three cutting passes. Thus, by means of the invention, there is a reduction factor equal to four in the number of cutting passes.

The invention also provides an electrical contact for a medium voltage vacuum circuit-breaker extending along a longitudinal axis Y and comprising:

- a mechanical connection portion that extends along the longitudinal axis Y;
- a contact body that includes:
  - a first winding as described above; and
  - a circular plate that has a diameter equal to the outside diameter of the first hollow cylinder, said plate also being centered on the longitudinal axis Y and being fastened to the end of the first hollow cylinder that is opposite from the end fastened to the mechanical connection portion.

In a variant, the helical slots of the first winding are of the right-handed type going from the mechanical connection portion to the circular contact plate. It is stated here that the term "right-handed" is as used in mathematics and means that an observer placed outside the contact sees the helixes going from left to right going from the mechanical connection portion towards the circular plate.

In an advantageous embodiment, the contact includes a second winding, of an arrangement that is the subject matter of the patent application FR 09 53852, filed on Jun. 10, 2009 by the Applicant and entitled [A contact for a medium-voltage vacuum circuit-breaker with improved arc extinction, and an associated vacuum circuit-breaker and circuit-breaker, such as an AC generator disconnector circuit-breaker].

This second winding is thus connected electrically in parallel with the first winding and is adapted to generate a magnetic field that is superposed on the magnetic field generated by the first winding.

In a first variant, the second winding may be constituted by a winding of the invention, with an angular length of each slot equal to at least 360°.

The second hollow cylinder is thus centered on the longitudinal axis Y, concentric with the first cylinder, having one end fastened to the mechanical connection portion and the other end fastened to the circular plate, the hollows of the cylinders being empty of material.

The helical slots of the second winding are of the right-handed type going from the mechanical connection portion to the circular contact plate.

The method of manufacture used (wire electric discharge machining) enables the second winding to be made at the same time as the main winding and by cutting the same block of material. There is therefore no additional part or additional cutting pass.

In an advantageous embodiment, the contact includes at least one column, such as is claimed in the patent application FR 09 53853, filed on Jun. 10, 2009 by the Applicant and entitled "Contact pour ampoule à vide à moyenne tension à structure renforcée, ampoule à vide et disjoncteur, tel qu'un disjoncteur sectionneur d'alternateur associés" [A contact for a medium-voltage vacuum circuit-breaker with reinforced structure, and an associated circuit breaker or vacuum circuit-breaker, such as an AC generator disconnector circuit-breaker]. The column is thus distinct from the winding(s) and arranged, in the hollow of the first cylinder, as a spacer between the mechanical connection portion and the circular plate of the contact body in such a manner as to avoid the collapse thereof during a closing operation and in the closed position of the vacuum circuit-breaker, the column(s) having high electrical resistance such that when a given current flows in the contact, the amount of current that flows in the column (s) is negligible relative to the current that flows in the winding(s).

The outside diameter of the first winding and of the circular plate lies in the range 90 mm and 150 mm, and that is completely suitable for an application in which the short-circuit currents to be broken have a value greater than or equal to 63 kA, typically up to 100 kA.

The invention also provides a medium voltage vacuum circuit-breaker comprising at least one electrical contact described above.

The vacuum circuit-breaker may include a pair of electrical contacts with one stationary contact as described above and a movable contact as described above.

Preferably, in the vacuum circuit-breaker, the slots of the windings of angular length that is greater than 360° open out to the side of the separating space between contacts where the arc is formed when the current is broken.

The invention also provides a circuit breaker, such as an AC generator disconnector circuit-breaker comprising at least one vacuum circuit-breaker as described above.

As a function of the application, a vacuum circuit-breaker of the invention may or may not carry the nominal load current, and it naturally carries the short-circuit current in the event of a fault

BRIEF DESCRIPTION OF THE DRAWINGS

Other advantages and features of the invention emerge more clearly on reading the detailed description given by way of non-limiting illustration with reference to the following figures, in which.

DETAILED DESCRIPTION OF THE EMBODIMENTS

Figure 1:
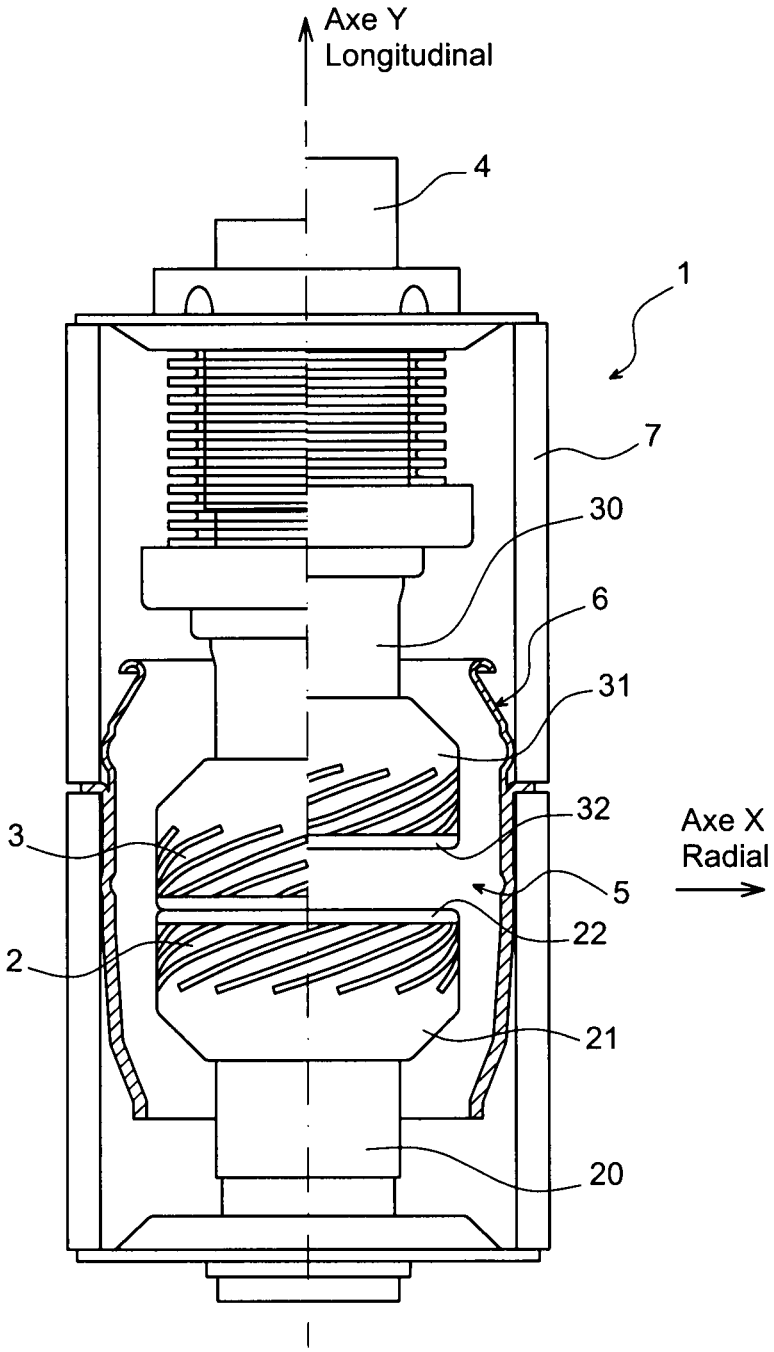
FIG. 1 is a view partly in vertical section of a medium-voltage vacuum circuit-breaker of the invention.

As shown in FIG. 1, a vacuum circuit-breaker 1 of the invention has a longitudinal axis Y and essentially includes a pair of contacts of which one contact 2 is stationary and the other contact 3 is moved by an operating rod 4 between an open position (the portion shown on the right-hand side) and a closed position (the portion shown on the left-hand side). The contacts 2 and 3 are of large size (diameter>35 mm).

The contacts 2, 3 in a vacuum circuit-breaker are usually separated in order to extinguish an arc that is liable to be produced in the separation space 5 between these contacts.

Whether in the closed position or the open position, the contacts 2, 3 are inside a shield 6 that is itself inside the jacket 7 of the circuit-breaker, within which there is a vacuum.

Breaking high alternating currents requires the arc that is generated to be controlled.

The arc control means are usually an integral part of the vacuum circuit-breaker. They must therefore ensure that the energy density of the arc at the contacts 2, 3 remains below acceptable limits in order to be able to break the current and to withstand the transient recovery voltage TRV.

One known type of arc control is axial magnetic field (AMF) arc control.

This entails generating an AMF parallel to the longitudinal axis Y of the bottle 1.

These AMF arc control means are supposed to prevent contraction of the arc and consequently to enlarge it over an area of the facing surfaces of the contacts that is as large as possible. The normal result of this is to distribute the energy of the arc over a larger area and thus to enable the current to be broken at the natural zero-crossing of the alternating current.

In other words, in order to diffuse the arc effectively over the facing contact surfaces, efficient AMF arc control requires the production of a high and uniformly distributed magnetic field that is really generated by the winding.

Figure 2:
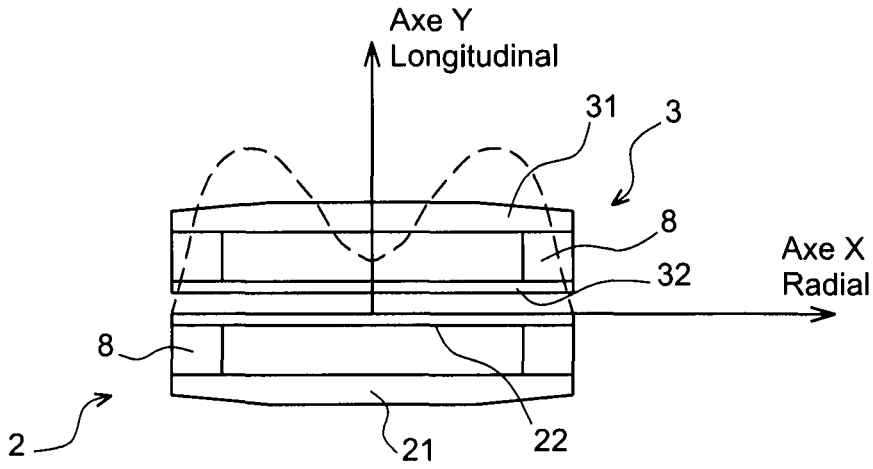
FIG. 2 is a diagrammatic view of the contacts of a medium-voltage vacuum circuit-breaker showing the magnetic field generated by an electrical contact in a prior art winding (dashed-line curve)

Thus these AMF arc control means are constituted by a component in the form of a coil or winding that consists of a hollow cylinder 8 arranged as shown in FIG. 2, i.e. at the periphery of the contact.

The hollow 80 of the winding 8 is empty of material. The hollow cylindrical winding 8 includes helical slots 81 around the longitudinal axis Y and opening out both to the inside and to the outside of the cylinder 8. The space between two consecutive slots 81 is defined by a strand 82.

Each contact 2, 3 includes a mechanical connection portion 20, 30 and a contact body 21, 31 fastened to this mechanical connection.

The body 21, 31 includes the winding 8 and an electrode portion 22, 32 in the form of a circular plate. This plate 22 or 32 constitutes the surface of mutual physical contact with the other plate 32 or 22 when the contacts are in the closed position.

These contact surfaces 22, 32 are therefore those over which the arc must be diffused as uniformly and as widely as possible.

Each winding 8 is fastened both to the mechanical connection portion 20 or 30 and to the circular plate 22 or 32.

The windings 8 and electrode portions 22, 32 of the invention typically have an outside diameter lying in the range 90 mm to 150 mm in applications in which the current to be broken has a value greater than or equal to 63 kA, e.g. 80 kA or higher.

Such an application that is particularly suitable is one in which the vacuum circuit-breaker is used as an AC generator circuit-breaker at the outlet of a power station.

Figure 3:
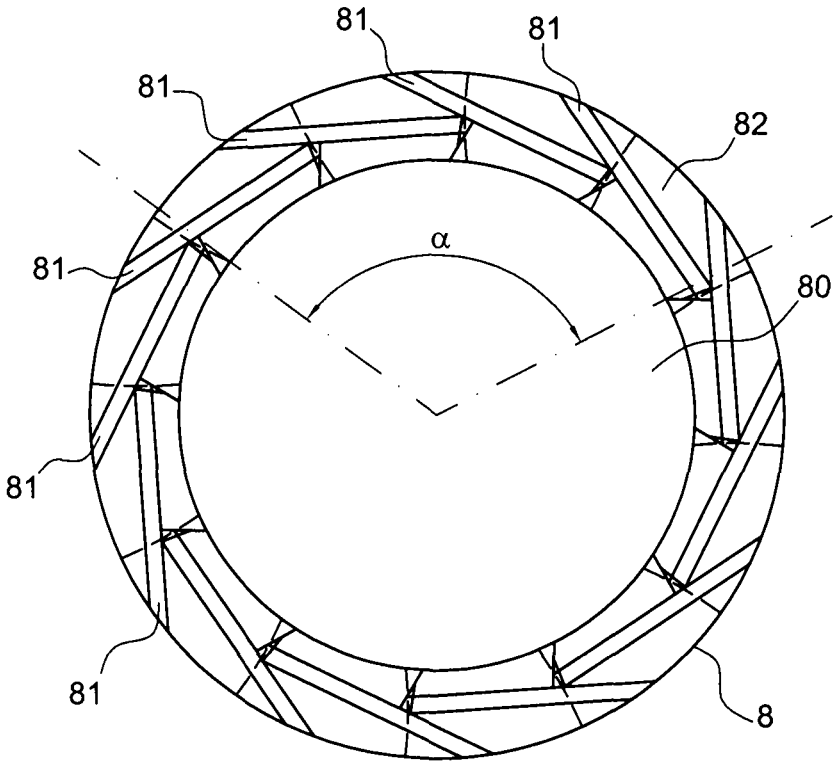
FIG. 3 is a view in cross-section of a copper-based prior art winding projected into a plane.

FIG. 3 is an example in a diagram showing a cross-section of a prior art winding 8, the section being projected in a single plane.

Along this section, it can be seen that the slot portions 81 are uniformly distributed on the diameter of the winding 8 (twelve of them) and all have the same dimensions. The angular length of a slot 81 is $\alpha$ of the order of 115°. This configuration corresponds to that described in the patent application in the name of the Applicant No. FR 09 53855, filed on Jun. 10, 2009, and entitled: "Enroulement pour contact d'ampoule à vide à moyenne tension à endurance améliorée, ampoule à vide et disjoncteur, tel qu'un disjoncteur sectionneur d'alternateur associés" [A winding for a contact of a medium-voltage vacuum circuit-breaker with improved endurance, and an associated circuit breaker or vacuum circuit-breaker, such as an AC generator disconnector circuit-breaker].

Figure 3A:
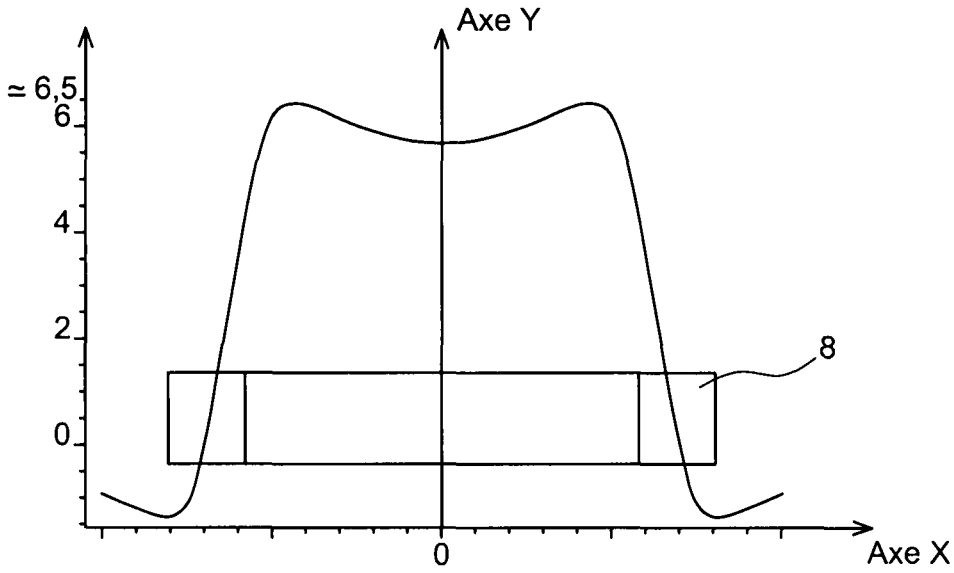
FIG. 3A is a graph showing the shape and the level of the magnetic field generated by an electrical contact incorporating a FIG. 3 winding.

FIG. 3A illustrates the appearance and the level of the AMF obtained by an electrical contact in a winding shown in FIG. 3, i.e. with helical slots but with an angular length $\alpha$ that is limited to 115°. It is stated here that a current $I_N$ of normalized value flows through the contact. The abscissa X of the curve shown represents the radial axis X of the contact 2. The AMF shown is thus along the radial axis X.

As indicated up the ordinate (y axis) the maximum value of the AMF obtained is about 6.5 units.

The total effective magnetic field obtained with a prior art winding (FIG. 3) with helical slots of an angular length of the order of 115° therefore has a generally high value and presents a very small amount of weakening in the center (X=0).

The inventors have sought to further increase the value of the magnetic field.

In other words the object of the invention is to generate a magnetic field of a high value while improving its uniformity on the contact surface and while reducing manufacturing costs.

In order to increase the total effective magnetic field in the contact, for contacts 2, 3 of large diameter (in the range 90 mm to 150 mm), the inventors have thus thought to increase the angular length of the helix of each slot 81.

Figure 4:
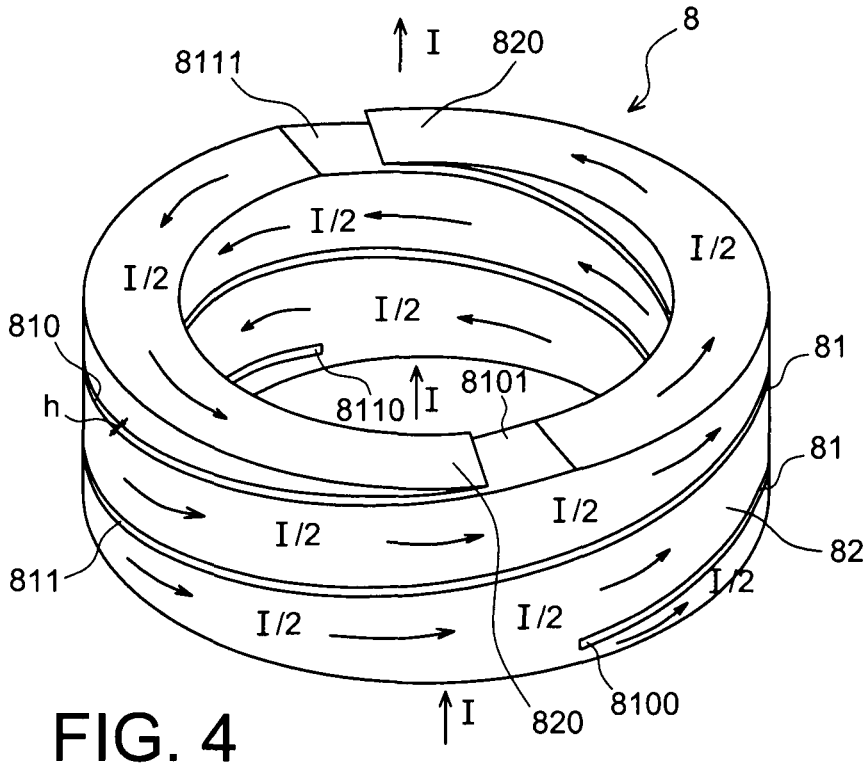
FIG. 4 is a perspective view of a winding in an embodiment of the invention.

FIG. 4 shows a first embodiment of a winding of the invention. The winding is constituted of a hollow cylinder 8 that includes two helical slots 810, 811 that are parallel to each other. Each helix 810, 811 has an angular length that is approximately of the order of 360°. This angular length of 360° corresponds to the angle traveled by moving along the length of each helix 810, 811 between its two ends 8100, 8101 respectively 8110, 8111. The ends 8101, 8111 of the slots 810, 811 that open out to the top portion of the cylinder 8 are diametrally opposite. The strands 82 of the hollow cylinder 8 defined individually by the two slots 810, 811 are of substantially the same height in their central portions, but with ends 820 of smaller height h, typically of the order of 1 mm. The current I that flows through the winding 8 thus flows along a helix of the right-handed type making one complete revolution over the entire height of the cylinder 8.

Figure 5:
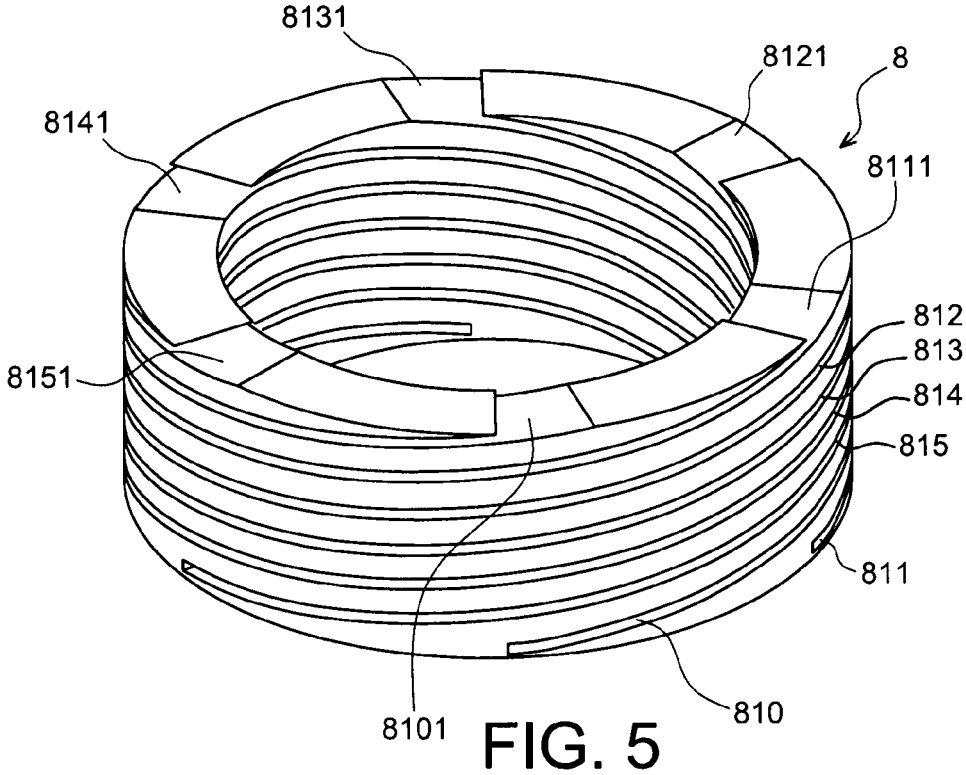
FIG. 5 is a perspective view of a winding in another embodiment of the invention.

FIG. 5 shows another embodiment of a winding of the invention. The hollow winding 8 constituting the winding includes six helical slots 810, 811, 812, 813, 814, 815 that are parallel to one another. Each helix 810-815 has, as shown in the embodiment of FIG. 4, an angular length of the order of 360°. The ends 8101, 8111, 8121, 8131, 8141 and 8151 that open out to the top portion of the cylinder 8 are evenly distributed, i.e. they are distant from each other by 60°.

Figure 5A:
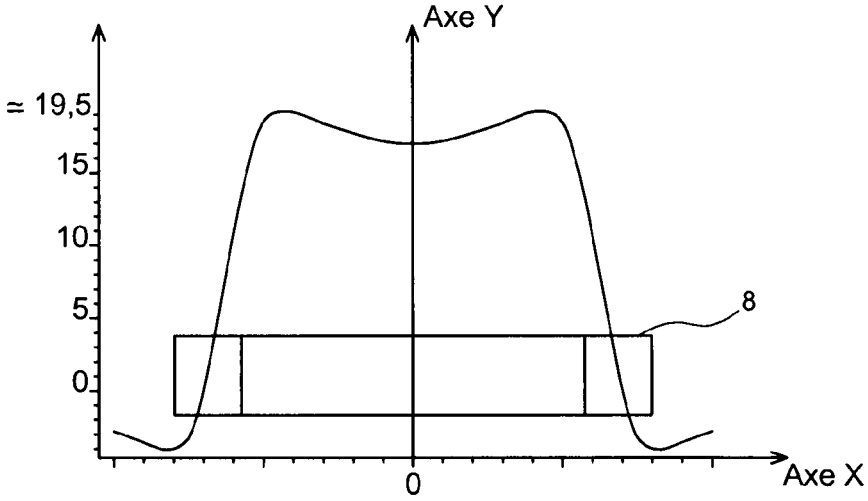
FIG. 5A is a graph showing the shape and the level of the magnetic field generated by an electrical contact incorporating a FIG. 5 winding.

FIG. 5A shows the shape and the level of the AMF obtained by an electrical contact in a winding shown in FIG. 5, i.e. with six helical slots 810-815 each with an angular length of the order of 360°. It is stated here that the test conditions are the same as for the contact with a prior art winding (FIG. 3): common winding 8 dimensions, common arrangement relative to the mechanical connection portion 20 and to the circular contact plate 22 and common normalized value of the current $I_N$ that flows through the winding.

The shape of the fields obtained respectively in FIGS. 3A and 5A are identical.

However, as indicated in ordinates in FIG. 5A, the maximum value of the AMF obtained for the winding of the invention is about 19.5 units.

Thus, the (circuit) gain in value of the AMF by means of the invention is equal to 3 (relationship between the maximum value of 19.5 of FIG. 5A and the maximum value of 6.5 of FIG. 3A).

Another electrical contact has been made according to the invention: it includes a first winding made as seen in FIG. 5 and a second winding as claimed in the patent application FR 09 53852, filed on Jun. 10, 2009, and entitled [A contact for a medium-voltage vacuum circuit-breaker with improved arc extinction, and an associated vacuum circuit-breaker and circuit-breaker, such as an AC generator disconnector circuit-breaker].

The second winding 9 is arranged concentrically in the first winding 8.

The second winding 9 is thus electrically connected in parallel with the first winding 8 and adapted to generate a magnetic field that is superposed on the magnetic field generated by the first cylinder 8.

It consists in a second hollow cylinder 9 including helical slots (not shown) about its axis and opening out both to the inside and outside of the cylinder. The second hollow cylinder 9 is centered on the longitudinal axis Y, concentric with the first cylinder 8, having one end fastened to the mechanical connection portion 20 and the other end fastened to the circular plate 22.

The two windings 8 and 9 are electrically mounted in parallel: thus the two cylinders are fastened to the base of connection 20 and to the electrode plate 22.

In contrast to the winding 8 of the invention, each helical slot of the second winding 9 is made with an angular length of at least 360°.

Preferably, the slots of angular length of at least 360° open out onto the plate 22 or 32, i.e. in the separating space 5 between contacts 2, 3 where the arc is formed when the current is broken.

Figure 6:
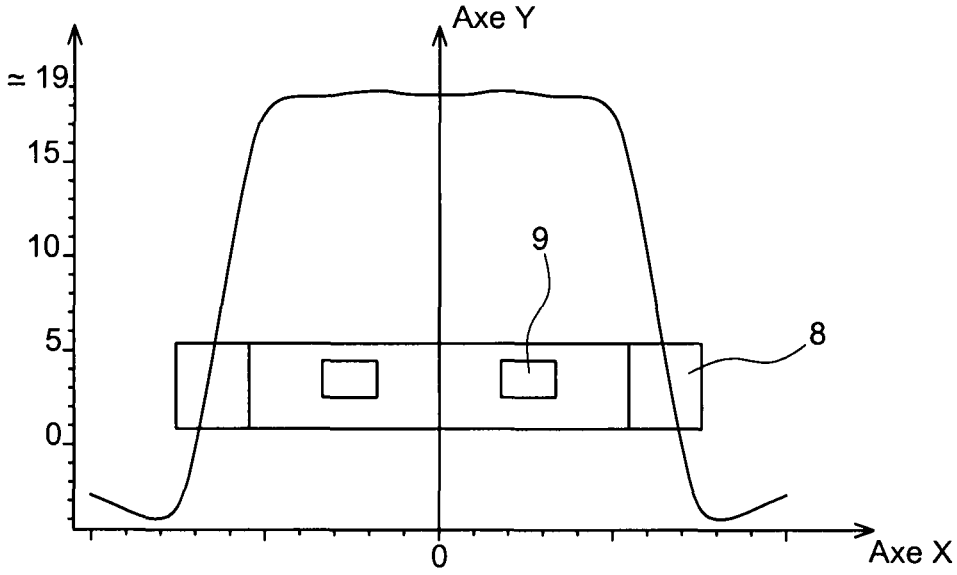
FIG. 6 is a graph showing the shape and the level of the magnetic field generated by an electrical contact incorporating both a winding of the invention and a prior art winding.

FIG. 6 shows the shape and the level of the AMF obtained by an electrical contact integrating both windings 8 and 9 as described above. It is stated here that the test conditions are the same as for the contact with a prior art winding (FIG. 3): common winding 8 dimensions, common arrangement relative to the mechanical connection portion 20 and to the circular contact plate 22 and common normalized value of the current $I_N$ that flows through the winding.

The shape of the fields obtained respectively in FIGS. 3A and 6 are different. Thus the arrangement of a second winding 9 as described above makes it possible to obtain an AMF without any weakening at the center of the contact of the winding.

However, as indicated up the ordinate in FIG. 6, the maximum value of the AMF obtained for the contact of the invention is about 19.

Thus, the (circuit) gain in value of the AMF by means of the invention is here of the order of 2.9 (relationship between the maximum value of 19 of FIG. 6 and the maximum value of 6.5 of FIG. 3A).

The above-described invention makes it possible to obtain the following advantages:

- increasing the AMF by a factor that may be in the range 2 to 3 relative to the AMF obtained with prior art windings;
- improving the distribution of the magnetic field generated by a winding of the invention: the winding generates a magnetic field that is better distributed on the contact surface when the arc is struck, which enables effective extinction of the arc currents;
- reducing the path of the eddy currents induced by the alternating current when it flows through the arc control. As it is known, these induced currents generate a magnetic field that is opposed to the axial magnetic field that is useful for breaking: the slots of the invention opening out to the surface create a discontinuity on the contact surface, and this reduces the path of the induced eddy currents;
- simplifying the method of making the winding and thus reducing the associated cost, the making of slots by electric discharge machining two by two or four by four (in the example of an additional inside winding) being simpler;
- obtaining slots of width smaller than 1 mm by using the electric discharge machining method;
- increasing the mechanical stability of a vacuum circuit-breaker contact including a winding of the invention. The increase in slot length and the constant thickness thereof increases de facto the length of the strands, and therefore their mechanical stability. This mechanical stability makes it possible to satisfy ANSI or IEC standards. The mechanical endurance of the vacuum circuit-breaker finds itself substantially improved so as to enable 30000 opening/closing cycles to be performed. The angular length of the strands advantageously greater than or equal to 360°, results in a linear length of the strands that is greater than that of the prior art coils. The electrical resistance of the strands is increased. This is a minor drawback of the invention compared to a prior art shape similar to that of FIG. 3, given that the increase in resistance is small. And the contribution of the winding to the total resistance of the vacuum circuit-breaker is minor. In addition, when the vacuum circuit-breaker is used only to break short circuit current and not to conduct the nominal current in a permanent manner, the resistance of the vacuum circuit-breaker has no effect on heating up the circuit breaker.

optimizing (reducing) the size and the cost of the winding as a result of the better stability of the AMF arc control;

avoiding the addition of additional ferromagnetic materials likely to lead to a deterioration of arc control;

avoiding making slots in the surface of contact 22 likely to reduce dielectric performance or behavior to modify the electrical characteristics by erosion of the contacts.

Other improvements are possible within the scope of the invention, namely making a winding 8 with helical slots 81 that are parallel to one another and of angular length equal to at least 360°. As described above, at least in part, it is possible to make an electrical contact 2, 3 that incorporates the winding of the invention and further:

a second winding 9 as described and claimed in the patent application FR 09 53852, filed on Jun. 10, 2009, and entitled [A contact for a medium-voltage vacuum circuit-breaker with improved arc extinction, and an associated circuit breaker or vacuum circuit-breaker, such as an AC generator disconnector circuit-breaker];

at least one column 7 as described and claimed in the patent application FR 09 53853, filed on Jun. 10, 2009, and entitled [A contact for a medium-voltage vacuum circuit-breaker with reinforced structure, and an associated circuit breaker or vacuum circuit-breaker, such as an AC generator disconnector circuit-breaker];

with a slot 81 of width smaller than one millimeter as described and claimed in the patent application FR 09 53855, filed on Jun. 10, 2009, and entitled [A winding for a contact of a medium-voltage vacuum circuit-breaker with improved endurance, and an associated circuit breaker or vacuum circuit-breaker, such as an AC generator disconnector circuit-breaker].

The invention claimed is:

1. An arc control structure based on a material of low electrical resistance and of a diameter typically greater than 90 mm, configured to generate a magnetic field in an electrical contact for a medium voltage vacuum circuit-breaker, comprising:

a hollow cylinder having a wall of a predetermined thickness and a predetermined circumference, the hollow cylinder including helical slots arranged in parallel around a central axis of the hollow cylinder and traversing the predetermined thickness of the wall of the hollow cylinder, a length of each helical slot being equal to at least the predetermined circumference of the hollow cylinder.

2. The structure according to claim 1, wherein a width of each helical slot is in the range of 0.5 mm and 1 mm for an outside diameter Øext of the hollow cylinder that is greater than 90 mm.

3. The structure according to claim 1, wherein each strand individually defined by two consecutive helical slots presents a section parallel to the central axis of the hollow cylinder that is substantially rectangular and identical over the entire height of the hollow cylinder.

4. The structure according to claim 1, wherein the hollow cylinder includes at least two parallel helical slots.

5. The structure according to claim 1, wherein the hollow cylinder includes at least six parallel helical slots.

6. The structure according to claim 1, wherein the material of low electrical resistance is copper.

7. An electrical contact for a medium voltage vacuum circuit-breaker extending along an longitudinal axis Y and comprising:

a mechanical connection portion that extends along the longitudinal axis Y;

a contact body that includes:

a first arc control structure based on a material of low electrical resistance and of a diameter typically greater than 90 mm, configured to generate a magnetic field in an electrical contact for a medium voltage vacuum circuit-breaker, the structure comprising a first hollow cylinder having a wall of a predetermined thickness and a predetermined circumference, the first hollow cylinder including helical slots arranged in parallel around a central axis of the first hollow cylinder and traversing the predetermined thickness of the wall of the first hollow cylinder, a length of each helical slot being equal to at least the predetermined circumference of the first hollow cylinder; and a circular plate that has a diameter equal to the outside diameter of the first hollow cylinder, said plate also being centered on the longitudinal axis Y and being fastened to the end of the first hollow cylinder that is opposite from the end fastened to the mechanical connection portion.

8. The electrical contact according to claim 7, wherein the helical slots of the first hollow cylinder are of the right-handed type going from the mechanical connection portion to the circular contact plate.

9. The electrical contact according to claim 7, further comprising a second arc control structure electrically connected in parallel with the first arc control structure and configured to generate a magnetic field that is superposed on the magnetic field generated by the first arc control structure.

10. The electrical contact according to claim 9, wherein the second arc control structure comprises a second hollow cylinder having a wall of a predetermined thickness and a predetermined circumference, the second hollow cylinder including helical slots arranged in parallel around a central axis of the second hollow cylinder and traversing the predetermined thickness of the wall of the second hollow cylinder, a length of each helical slot being equal to at least the predetermined circumference of the second hollow cylinder, the second hollow cylinder being centered on the longitudinal axis Y, concentric with the first hollow cylinder, having one end fastened to the mechanical connection portion and another end fastened to the circular plate, hollow insides of the first and second hollow cylinders being empty of material.

11. The electrical contact according to claim 10, wherein the helical slots of the second hollow cylinder are of the right-handed type going from the mechanical connection portion to the circular contact plate.

12. The electrical contact according to claim 7, comprising at least one column distinct from the first arc control structure and arranged, inside of the first hollow cylinder, as a spacer between the mechanical connection portion and the circular plate of the contact body to avoid collapse thereof during a closing operation and in the closed position of the vacuum circuit-breaker, the at least one column having high electrical resistance such that when a given current flows in the contact, an amount of current that flows in the at least one column is negligible relative to a current that flows in the first arc control structure.

13. The electrical contact according to claim 7, wherein an outside diameter of the first arc control structure and of the circular plate lies in the range of 90 mm and 150 mm.

14. A medium voltage vacuum circuit-breaker, comprising:

at least one electrical contact according to claim 7.

15. The vacuum circuit-breaker according to claim 14, the at least one electrical contact includes a pair of electrical contacts with a stationary contact and a movable contact.

16. The vacuum circuit-breaker according to claim 14, wherein the vacuum circuit-breaker may or may not carry a nominal load current, and carries a short-circuit current in the event of a fault.

17. The vacuum circuit-breaker according to claim 14, wherein the helical slots of the first and second hollow cylinders open out to a side of the separating space between contacts where an arc is formed when the current is broken.

18. An AC generator disconnector circuit-breaker, comprising:

at least one vacuum circuit-breaker according to claim 17.

19. A method of making an arc control structure based on a material of low electrical resistance configured to generate a magnetic field in an electrical contact for a medium voltage vacuum circuit-breaker, the method comprising:

making a hollow cylinder having a wall of a predetermined thickness and a predetermined circumference, the hollow cylinder including helical slots arranged in parallel around a central axis of the hollow cylinder, each the helical slots fully traversing a wall of the hollow cylinder and traversing the predetermined thickness of the wall of the hollow cylinder, a length of each helical slot being equal to at least the predetermined circumference of the hollow cylinder.

20. The method according to claim 19, wherein the helical slots are made by electric discharge machining.

* * * * *